US005367226A

United States Patent [19]

Ukegawa et al.

[11] Patent Number: 5,367,226

[45] Date of Patent: Nov. 22, 1994

[54] ELECTRODELESS DISCHARGE LAMP HAVING A CONCAVE RECESS AND FOIL ELECTRODE FORMED THEREIN

[75] Inventors: Shin Ukegawa; Shigeaki Wada; Atsunori Okada; Shingo Higashisaka; Miki Kotani, all of Kadoma, Japan

[73] Assignee: Matsushita Electric Works, Ltd., Osaka, Japan

[21] Appl. No.: 190,215

[22] Filed: Feb. 1, 1994

Related U.S. Application Data

[63] Continuation of Ser. No. 928,419, Aug. 12, 1992, abandoned.

[30] Foreign Application Priority Data

| | | | |
|---|---|---|---|
| Aug. 14, 1991 | [JP] | Japan | 3-203090 |
| Oct. 15, 1991 | [JP] | Japan | 3-265625 |
| Dec. 13, 1991 | [JP] | Japan | 3-329245 |
| Dec. 13, 1991 | [JP] | Japan | 3-329250 |

[51] Int. Cl.[5] ..... H05B 41/16

[52] U.S. Cl. ..... 315/248; 315/39; 315/344

[58] Field of Search ..... 315/248, 344, 39; 313/234, 485

[56] References Cited

U.S. PATENT DOCUMENTS

| | | | |
|---|---|---|---|
| 2,223,399 | 12/1940 | Bethenod | 315/248 |
| 4,727,294 | 2/1988 | Houkes et al. | 315/248 |
| 4,894,590 | 1/1990 | Witting | 315/248 |
| 4,902,937 | 2/1990 | Witting | 315/248 |
| 4,982,140 | 1/1991 | Witting | 315/248 |
| 5,032,757 | 7/1991 | Witting | 315/248 |
| 5,057,750 | 10/1991 | Farrall et al. | 315/248 |
| 5,059,868 | 10/1991 | El-Hamamsy et al. | 315/248 |
| 5,084,654 | 1/1992 | El-Hamamsy et al. | 313/234 |
| 5,095,249 | 3/1992 | Roberts et al. | 313/234 |
| 5,140,227 | 8/1992 | Dakin et al. | 313/234 |
| 5,157,306 | 10/1992 | Witting | 313/234 |
| 5,306,987 | 4/1994 | Dakin et al. | 315/248 |

FOREIGN PATENT DOCUMENTS 1159356 11/1989 Japan .

*Primary Examiner*—Robert J. Pascal
*Assistant Examiner*—Michael B. Shingleton
*Attorney, Agent, or Firm*—Leydig, Voit & Mayer

[57] ABSTRACT

An electrodeless discharge lamp includes a single type auxiliary electrode for preliminary discharging, disposed on or adjacent to outer peripheral wall of lamp tube at a position for being electrostatically coupled to interior space of the tube, and supplied with a power from a second high frequency power source other than a first high frequency power source supplying a high frequency power to a main induction coil on the tube, whereby the lamp is made to attain an excellent startability without requiring any large size high frequency power source.

2 Claims, 11 Drawing Sheets

ELECTRODELESS DISCHARGE LAMP HAVING A CONCAVE RECESS AND FOIL ELECTRODE FORMED THEREIN

This disclosure is a continuation of application Ser. No. 07/928,419, filed Aug. 12, 1992, now abandoned.

BACKGROUND OF THE INVENTION

This invention relates generally to an electrodeless discharge lamp and, more particularly, to a discharge lamp having no electrode inside lamp tube and causing an excitation luminescence of discharging gases sealed within the lamp tube to be generated with an externally applied high frequency electromagnetic field to the gases.

The electrodeless discharge lamp of the kind referred to has been subjected to researches and development for providing to the lamp such features as being small in size, still high in the output, long in the life and so on, so as to be usefully employable as a high output point source of light or the like.

DESCRIPTION OF RELATED ART

There have been known various electrodeless discharge lamps arranged for the luminescence with the discharging gases in the lamp tube excited by the high frequency electromagnetic field acted upon the gases, in which the high frequency electromagnetic field is generally caused to be acted by means of an induction coil wound around the tube.

While an initial starting of such discharge lamp is made relatively easy by an addition of a luminous substance to the discharging gases sealed in the tube, a re-starting is made rather difficult. Further, there has been a problem, in particular, that a temperature rise in the lamp tube upon its lighting causes vapor pressure of the luminous substance to vary in a manner of exponential function so as to be difficult to take its matching with a high frequency power source for applying a high frequency current to the induction coil, and the discharge lamp is caused to flicker out when the matching cannot be taken. When the luminous substance is not added to the discharging gas, it becomes easier to take the matching with the high frequency power source, but the gas pressure has to be made higher for obtaining a sufficient quantity of light, and the initial starting is thereby made difficult. While an application of a relatively high voltage to the induction coil may result in a forcible starting of the lamp, this causes another problem to arise in that a high frequency power source capable of applying a high voltage is required therefor so that the high frequency power source as a lighting circuit will have to be enlarged in size to render the entire electrodeless discharge lamp fixture to be eventually larger.

In order to eliminate the above problem, there have been suggested in, for example, U.S. Pat. Nos. 4,894,590, 4,902,937 and 4,982,140 to H. L. Witting, U.S. Pat. No. 5,057,750 to G. A. Farrall et al, and U.S. Pat. No. 5,059,868 to S. A. El-Hamamsy et al various electrodeless discharge lamps having a starting means for executing a preliminary discharge in advance of and separately from a main discharge by means of a main induction coil.

In these known electrodeless discharge lamps, in general, a lighting of the lamps with the supply of high frequency current to the main induction coil wound on the periphery of the lamp tube causes an induced electric field to be produced within the lamp tube by the high frequency electromagnetic field so as to interlink this electromagnetic field, and a discharge plasma is caused to run along this induced electric field. Since the induced electric field occurs within a plane perpendicular to the magnetic flux, the discharge plasma runs along a winding direction of windings of the induction coil upon the discharge lamp lighting. On the other hand, the discharging caused by the starting means occurs in a direction intersecting at right angles the induced electric field and is subjected at both ends to a restriction of the starting means, so that a relatively large energy will be required for shifting the plasma arc discharge from the state of preliminary discharging state by the starting means to the state in which the discharge plasma runs along the induced electric field. That is, this arrangement for the discharge lamp starting involves such a problem that, in practice, the known discharge lamps are uneasy to be sufficiently smoothly started.

SUMMARY OF THE INVENTION

Therefore, it is a primary object of the present invention to provide an electrodeless discharge lamp which has eliminated the foregoing problems and is capable of being easily started, rendering any large size high frequency power source to be unnecessary, and being formed to be relatively compact.

According to the present invention, this object can be realized by an electrodeless discharge lamp wherein a high frequency current is supplied from a high frequency power source to an induction coil disposed on the exterior of a lamp tube of a light-transmitting material and containing a discharge gas sealed therein for an excitation luminescence of the gas with a high frequency electromagnetic field made to act upon the gas, and means is provided for causing a preliminary discharge of the discharge gas in the lamp tube to take place prior to the excitation luminescence by means of the induction coil, characterized in that the preliminary discharge means comprises a single auxiliary electrode provided adjacent to outer peripheral wall of the lamp tube at a position to be electrostatically coupled to interior space of the lamp tube, and a second high frequency power source separate from said first high frequency power source for the high frequency power supply to the induction coil.

All other objects and advantages of the present invention shall be made clear in following description of the invention detailed with reference to preferred embodiments of the invention shown in accompanying drawings.

Figure 1:
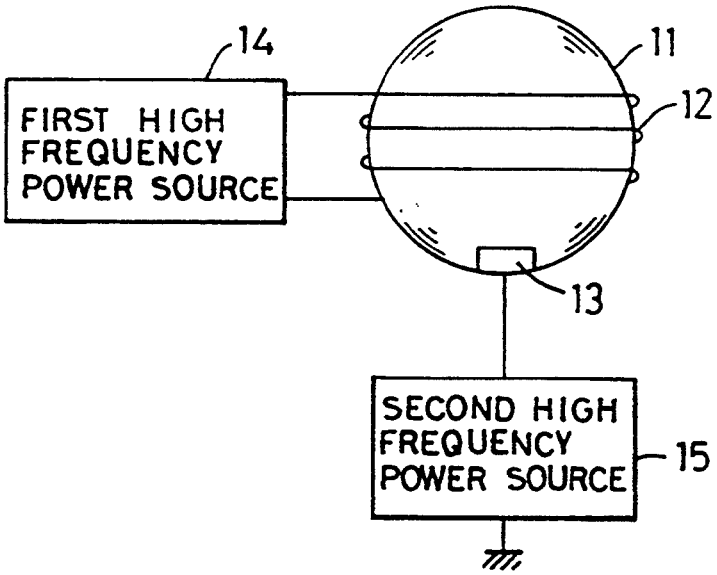
FIG. 1 shows in a schematic diagram an arrangement of the electrodeless discharge lamp in an embodiment according to the present invention.

While the present invention shall now be described in detail with reference to the respective embodiments shown in the drawings, it will be appreciated that the intention is not to limit the present invention only to these embodiments shown but rather to include all alterations, modifications and equivalent arrangements possible within the scope of appended claims.

DETAILED DESCRIPTION OF THE PREFERRED EMBODIMENTS

Referring to FIG. 1, there is shown an embodiment of the electrodeless discharge lamp according to the present invention, in which the electrodeless discharge lamp comprises a lamp tube 11 formed into a spherical shape preferably with such light-transmitting material as a silica glass or the like, and xenon gas is sealed within the tube as a discharge gas under a pressure of 100 Torr. Peripherally around the lamp tube 11, there is wound an induction coil 12, and a single type auxiliary electrode 13 is provided to be adjacent to outer surface of the lamp tube 11. While the induction coil 12 is shown in FIG. 1 as wound in three turns, the number of coil turn is not required to be particularly limited but may only be required to be more than one turn. The auxiliary electrode 13 is formed with a metal foil into a square shape of each 10 mm side, for example, and is disposed in the present instance on one end side of axial line of the induction coil 12.

First high frequency power source 14 is provided for supplying a high frequency current to the induction coil 12, so that a high frequency electromagnetic field will be thereby applied from the coil 12 to act upon the discharge gas within the lamp tube 11 for causing an excitation luminescence of the discharge gas to take place inside the lamp tube 11, upon which an induction electric field is generated within the lamp tube 11 by the action of the high frequency electromagnetic field, and a discharge plasma occurring in the tube 11 is maintained by this induction electric field.

To the auxiliary electrode 13, on the other hand, there is applied a high frequency voltage from a second high frequency power source, and there occurs a string-shape preliminary discharge due to a high frequency electric field generated around the auxiliary electrode 13. In this case, the preliminary discharge is to be generated as the result of ionization of electrons accelerated by the high frequency electric field occurring around the auxiliary electrode 13 and caused to collide with atoms of the discharge gas. Since the auxiliary electrode 13 is of the single type, the thus generated preliminary discharge is subjected to a restriction only at one end by the auxiliary electrode 13, and the other end of the discharge is kept to be a free end so as to be relative freely shiftable.

The first and second high frequency power sources 14 and 15 comprise respectively a high frequency generating section for a high frequency output, an amplifier section for a power amplification of the high frequency output, a matching section for taking an impedance matching with the induction coil 12 or with the auxiliary electrode 13, and so on. In practice, the second high frequency power source 15 is to apply the high frequency voltage across the auxiliary electrode 13 and an earth.

Figure 2A:
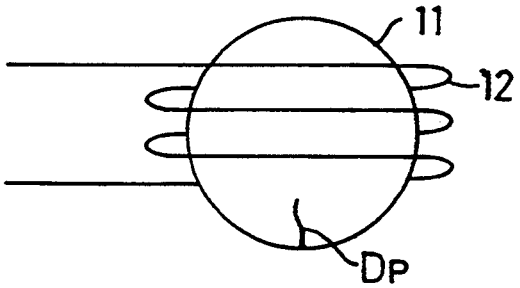
FIGS. 2A to 2D are explanatory views for the operation of the electrodeless discharge lamp of FIG. 1.
Figure 2C:
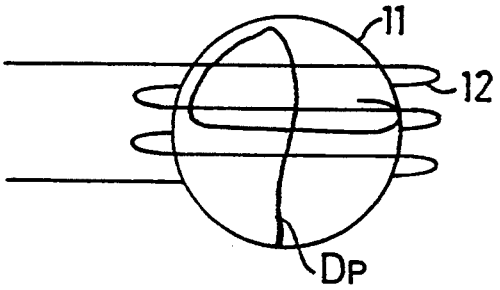
Figure 2B:
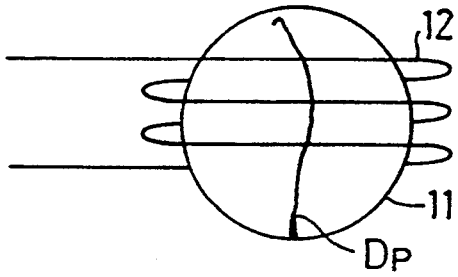
Figure 2D:
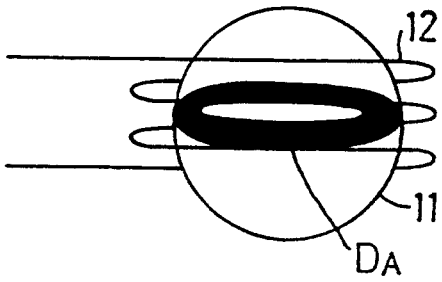

Now, in the electrodeless discharge lamp shown in FIG. 1, the high frequency voltage is applied from the second high frequency power source 15 across the auxiliary electrode 13 and the earth, and a preliminary discharge $D_P$ is thereby caused to occur inside the tube 11 nearby the auxiliary electrode 13, which discharge $D_P$ gradually grows to extent upward from the position of the auxiliary electrode 13 and reaches the other end side of the tube 11, as shown in FIGS. 2A and 2B. Here, the high frequency current is fed to the induction coil 12 from the first high frequency power source 14, the extended free end of the preliminary discharge $D_P$ is induced to further extend along the induction electric field occurring due to the high frequency electromagnetic field generated around the induction coil 12, so as to form an annular discharge path as shown in FIG. 2C. As the annular discharge path is completed, the discharge is to shift to such arc-shaped discharge $D_A$ as shown in FIG. 2D, whereby the discharge plasma is caused to occur, a strong luminescence takes place as the result of the excitation of the discharge gas, and a lighting state is reached. After this shift to the lighting state, the application of the high frequency voltage to the auxiliary electrode 13 becomes unnecessary.

While in the above the high frequency current has been referred to as being supplied to the induction coil 12 after the occurrence of the preliminary discharge $D_P$, it is also possible to start supplying the high frequency current to the induction coil 12 simultaneously with the application of the high frequency voltage to the auxiliary electrode 13 and to have the supplied high frequency current to the induction coil 12 increased after the occurrence of the preliminary discharge $D_P$. For the discharge gas, it is possible to use any other single gas than xenon or a mixture of gases. While the auxiliary electrode 13 has been disclosed as being formed by the metal foil of square shape of each 10 mm side, further, the same is not required to be specifically limited in size and shape, as well as in the position of provision.

It should be appreciated that, according to the foregoing electrodeless discharge lamp, the string-shaped preliminary discharge can be generated with the application of the high frequency voltage to the single type auxiliary electrode 13, and its shift to the arc discharge $D_A$ is rendered easier.

In another working aspect of the electrodeless discharge lamp according to the present invention, while not always necessary, it is possible to use as the discharge gas a mixture of a rare gas with a metal or a metal halide as a luminescent substance. The metal and metal halide may be of a single substance or a mixture. For example, such halide as NaI-TlI-InI or the like is mixed with the rare gas. With the use of such discharge gas containing the luminescent substance admixed, there is generated the excitation luminescence of the rare gas immediately after the shift to the arc discharge, and the luminescence is of white color when the rare gas is xenon. Accordingly, it is made possible to obtain a high luminous brightness from the initial stage of the discharge lamp lighting so that an electrodeless discharge lamp of quickly rising discharge and of a high brightness can be obtained. In the present working aspect, other constituents are the same as those in the embodiment of FIG. 1 except for the difference in the discharge gas.

Figure 3:
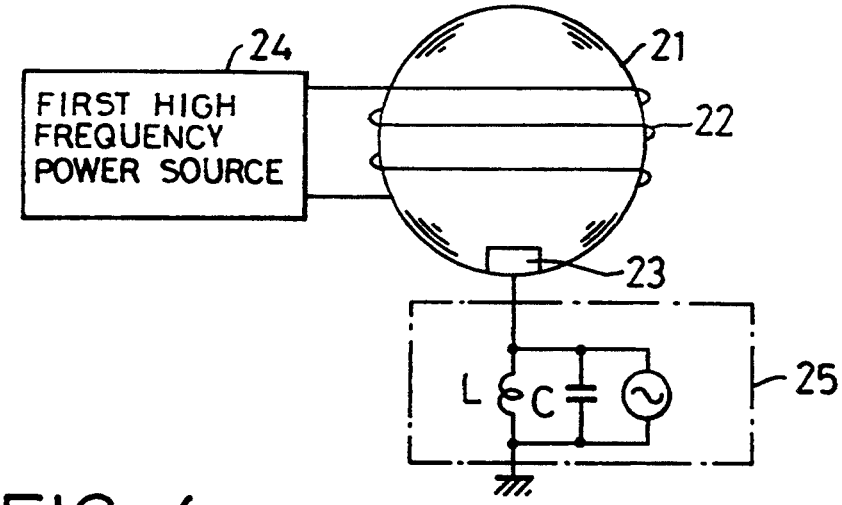
FIGS. 3 through 11 are schematic diagrams showing respective other embodiments of the electrodeless discharge lamp according to the present invention.

In another embodiment of the electrodeless discharge lamp of the present invention as shown in FIG. 3, there is utilized an advantage that required circuit designing work for the first and second high frequency power sources 24 and 25 can be made easier by the independent provision of the second high frequency power source 25 for the auxiliary electrode 23 as separated from the first high frequency power source 24 for the induction coil 22 wound on the lamp tube 21. In the present instance, there is disposed at an output section of the second high frequency power source 25 a parallel resonance circuit of an inductor L and capacitor C connected in parallel to each other, while a series resonance circuit may alternatively employed. In this embodiment, all other constituents are the same as those in the embodiment of FIG. 1, except for the arrangement at the output section of the second high frequency power source 25.

Figure 4:
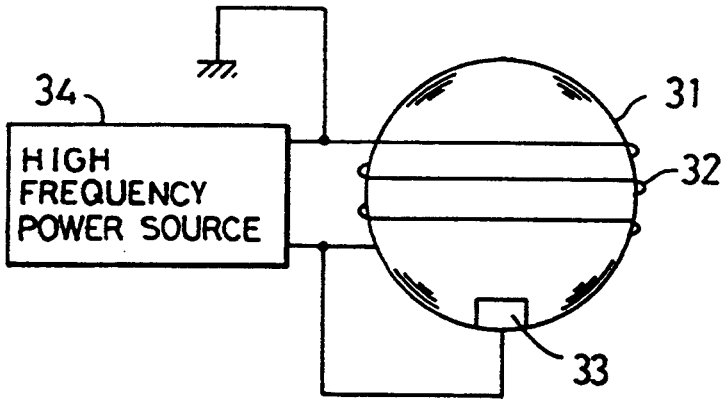
Figure 5:
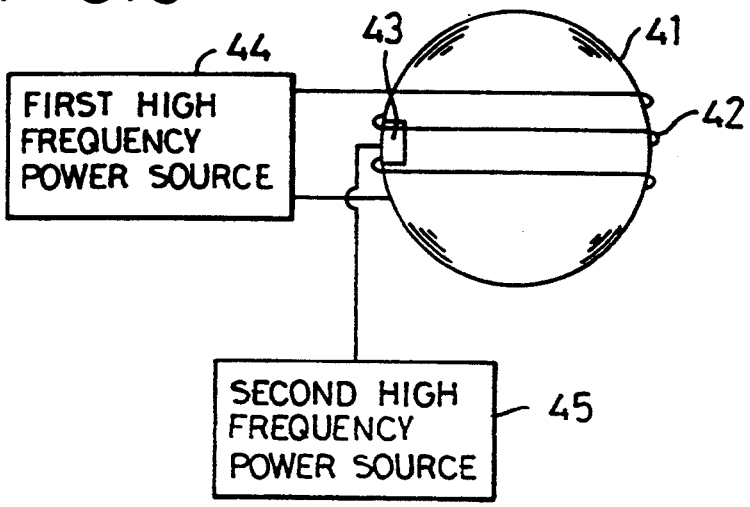

According to another embodiment of the electrodeless discharge lamp according to the present invention as shown in FIG. 4, the high frequency power source 34 for supplying the high frequency current to the induction coil 32 wound on the lamp tube 31 is earthed at one of output terminals and connected at the other output terminal to the auxiliary electrode 33, so that a simpler arrangement in which the second high frequency power source is included in the first high frequency power source 34 can be realized. Also in this embodiment shown in FIG. 4 of the present invention, all other constituents are the same as those in the embodiment of FIG. 1, except for the simpler arrangement of the high frequency power source.

Figure 6:
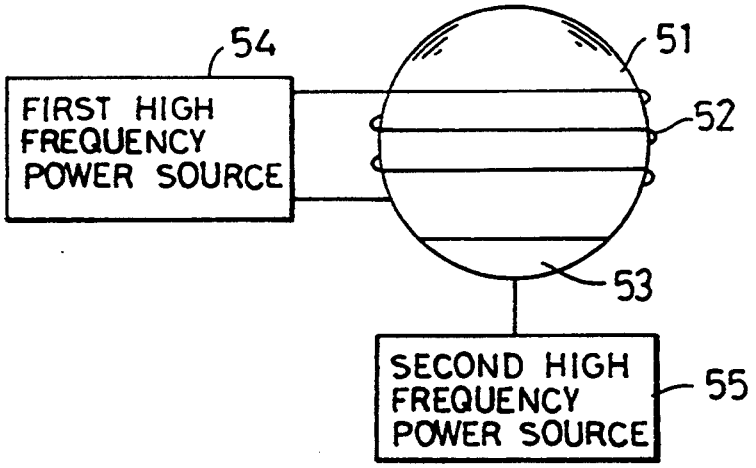

In another embodiment shown in FIG. 6 of the electrodeless discharge lamp according to the present invention, the auxiliary electrode 53 is formed on the outer wall surface of the lamp tube 51 as a metal film by means of a deposition or the like process. For this metal deposition, it is advantageous to employ, for example, platinum so that the auxiliary electrode 53 is improved in the degree of adhesion with respect to the lamp tube 51, better than in the case of the embodiment of FIG. 1. That is, according to the embodiment of FIG. 1, the metal foil is employed as the auxiliary electrode so that there will arise certain complicated factors when a sufficient contact of the metal foil with the spherical outer wall surface of the lamp tube, whereby the eventual contact is caused to be limited to be of the one at multiple points on the wall surface of the lamp tube, and it may happen that the action of the high frequency electric field occurring around the auxiliary electrode with respect to the discharge gas is insufficient. In the present embodiment, on the other hand, the degree of adhesion of the auxiliary electrode 53 with respect to the lamp tube 51 can be sufficiently elevated, and the action of the high frequency electric field occurring around the auxiliary electrode 53 upon the discharge gas can be made sufficient. In accompaniment to this, it is made possible to have the preliminary discharge $D_P$ generated by a relatively low energy, and the discharge lamp can be improved in the startability. Further, the lamp tube 51 is improved in the heat retaining properties so that, in the event where the luminous substance is mixed in the discharge gas, the vapor pressure of the luminous substance is thereby elevated to increase the amount of luminescence, and the discharge lamp can be improved in the input/output efficiency. Including the induction coil and first and second high frequency power sources, all other constituents in this embodiment are the same as those in the foregoing embodiment of FIG. 1.

Figure 7:
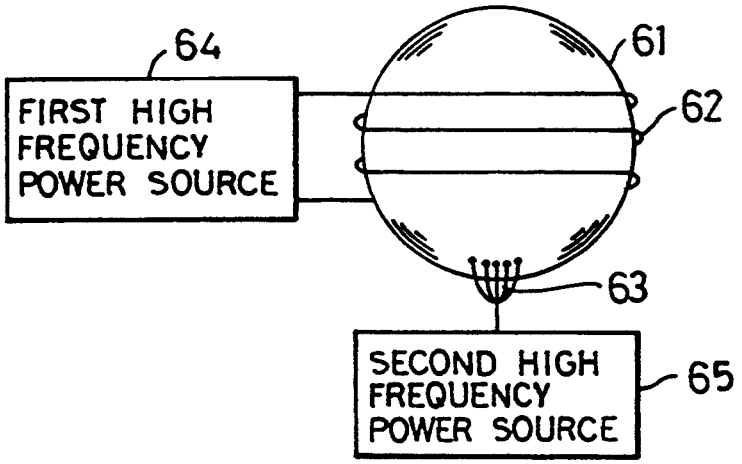

In a further embodiment shown in FIG. 7 of the electrodeless discharge lamp according to the present invention, the auxiliary electrode 63 is formed by a bundle of thin metal wires in a brush shape. While the respective thin metal wires of this auxiliary electrode 63 attain only the contact of multiple points with the lamp tube 61, the brush-shaped bundle of the thin metal wires allows the multiple point contact to be of a high density enough for enhancing the action of the high frequency electric field with respect to the discharge gas, more than that attainable with the auxiliary electrode of such metal foil as in the embodiment of FIG. 1. In other words, the required energy amount for energizing the auxiliary electrode can be decreased while establishing the intended purpose. In the instant embodiment, all other constituents including the lamp tube 61, induction coil 62 and first and second high frequency power sources 64 and 65 are the same as those in the embodiment of FIG. 1.

Figure 8:
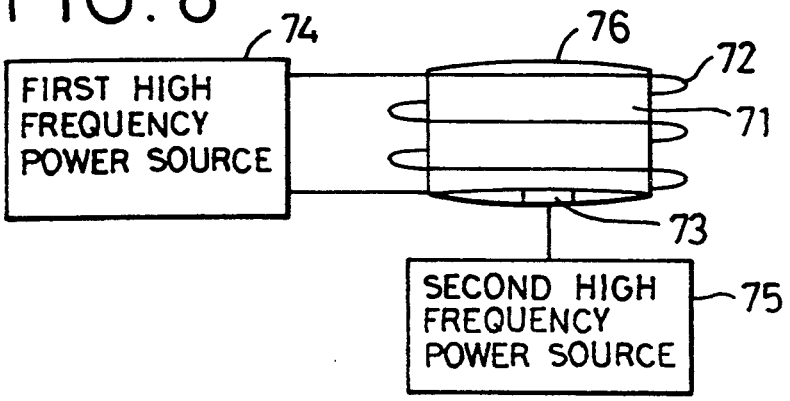

According to another embodiment shown in FIG. 8 of the electrodeless discharge lamp according to the present invention, the lamp tube 71 is of a cylindrical member, the induction coil 72 is wound on cylindrical periphery of the member, and the auxiliary electrode 73 is provided on one of substantially flat axial end faces of the cylindrical member, while the other end face functions as a main luminous surface 76 which is substantially flat. In such case as the embodiment of FIG. 1 where the lamp tube is spherical, there remains a possibility that the induced electric field due to the high frequency electromagnetic field occurring around the induction coil cannot act sufficiently upon the free end of the preliminary discharge $D_P$ extended so as to be out of the zone surrounded by the coil as shown in FIG. 2B. In the present instance, on the other hand, the cylindrical lamp tube 71 renders the distance from the auxiliary electrode 73 to the extended free end of the preliminary discharge $D_P$ to be shorter to render the action of the electric field sufficient, the discharge shift from the preliminary discharge $D_P$ to the arc discharge $D_A$ is made thereby to be easier, and the discharge lamp can be improved in the startability. In the instant embodiment, all other constituents including the first and second high frequency power sources 74 and 75 are the same as those in the embodiment of FIG. 1.

Figure 9:
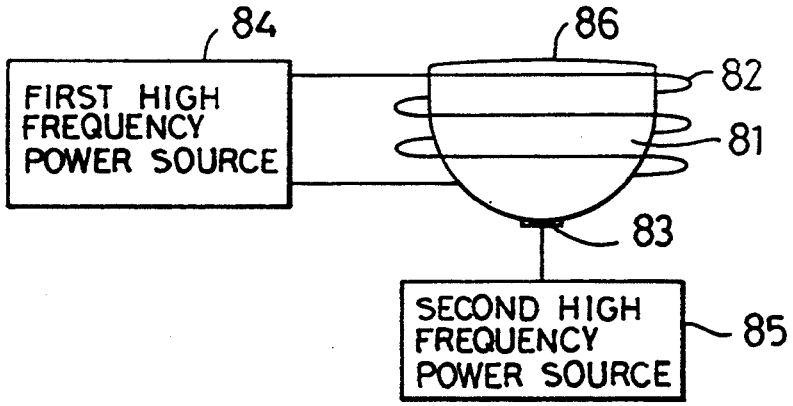

In another embodiment shown in FIG. 9 of the electrodeless discharge lamp according to the present invention, the lamp tube 81 is formed to be substantially hemispherical, so as to have a substantially cylindrical central part on which the induction coil 82 is wound, a spherical axial end surface on which the auxiliary electrode 83 is provided, and the other axial end surface substantially flat and acting as the main luminescent surface 86. In this embodiment, all other constituents including the first and second high frequency power sources 84 and 85 are the same as those in the embodiment of FIG. 1 or 8.

Figure 10:
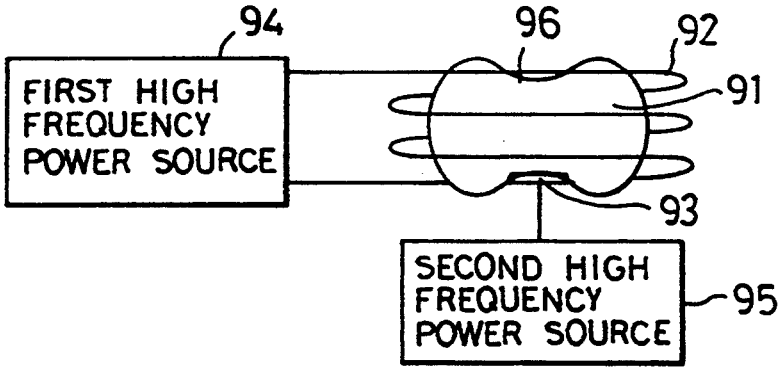

In another embodiment shown in FIG. 10 of the electrodeless discharge lamp according to the present invention, the lamp tube 91 is of a half-compressed ball shape having a swelling periphery on which the induction coil 92 is wound, and two concave axial end surfaces on one of which the auxiliary electrode 93 is provided and the other of which is to act as the main luminescent surface 96. In this embodiment, all other constituents are the same as those in the embodiment of FIG. 1.

Figure 11:
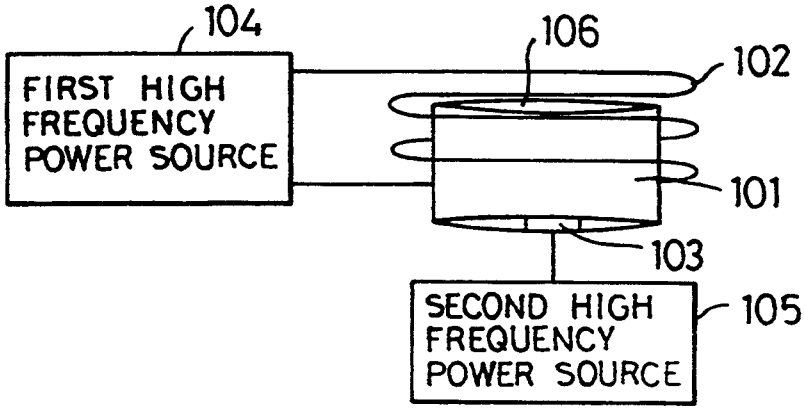
Figure 12:
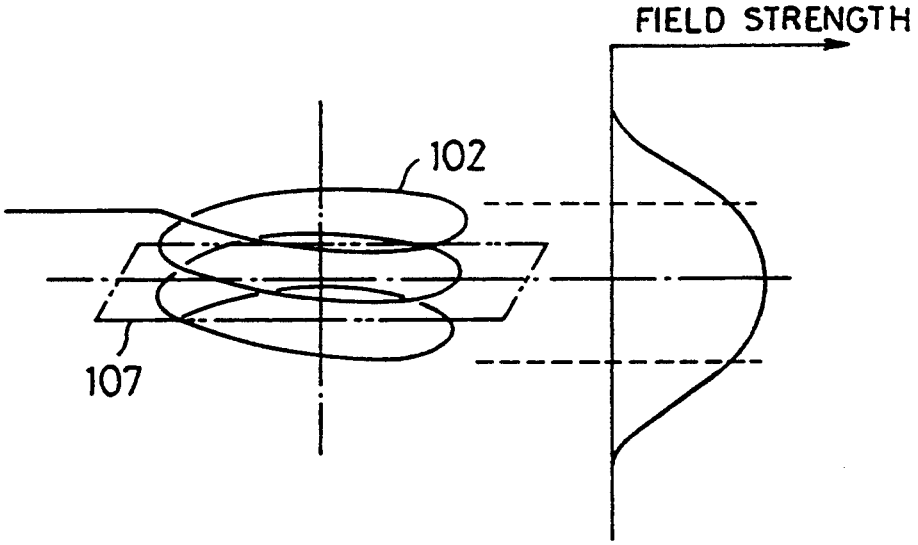
FIG. 12 is an explanatory view for the operation of the discharge lamp in the embodiment of FIG. 11.
Figure 13:
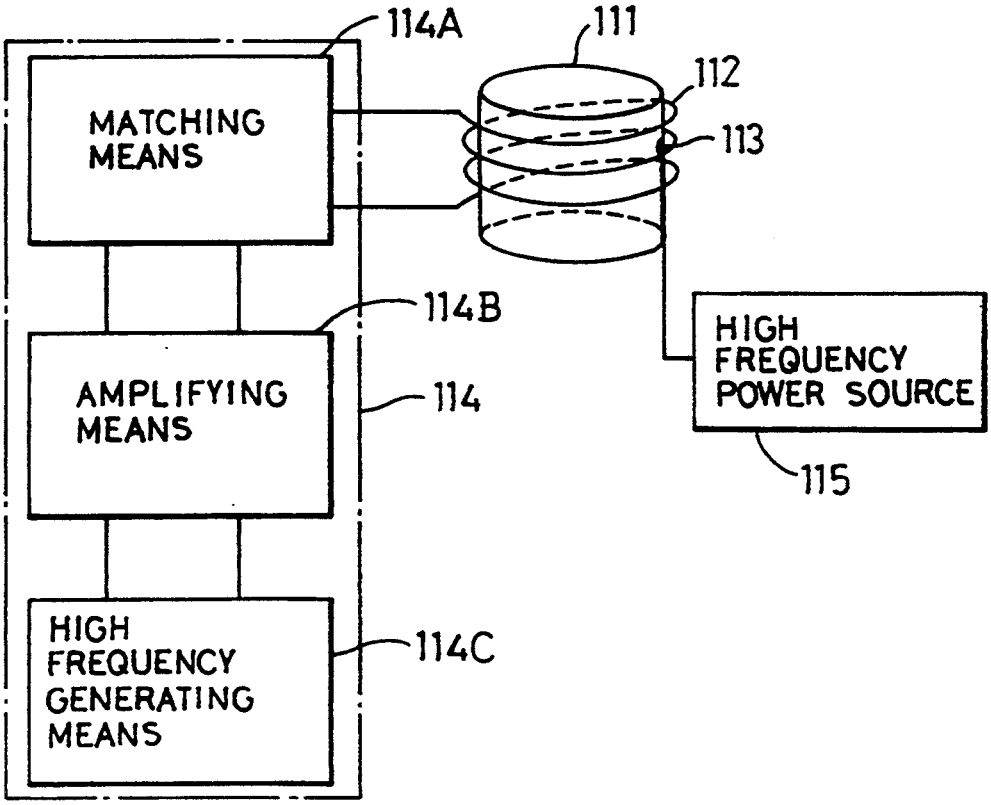
FIG. 13 shows in a schematic diagram an arrangement of the discharge lamp in another embodiment according to the present invention.
Figure 14:
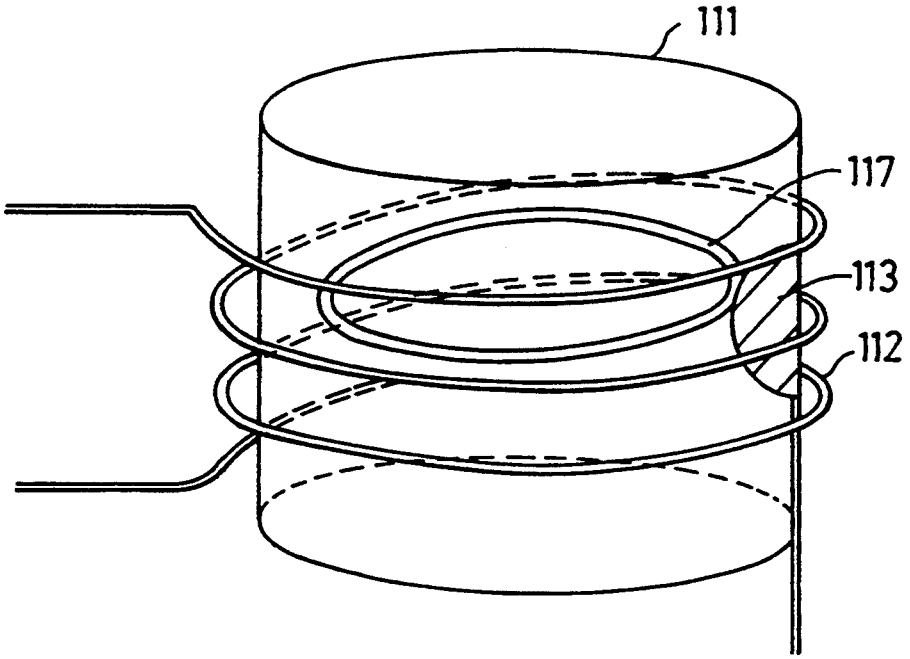
FIG. 14 is a perspective view as magnified of a lamp tube in the embodiment of FIG. 13.
Figure 15:
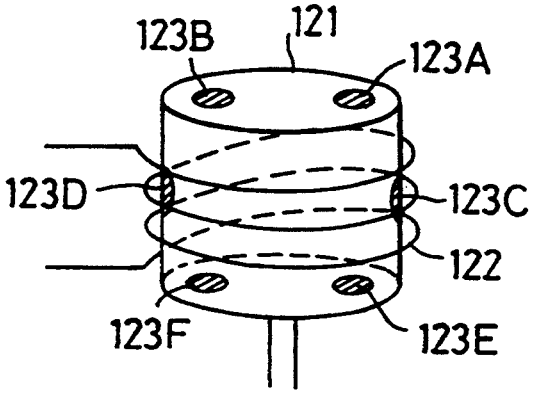
FIG. 15 is a schematic diagram of the lamp tube for positioning arrangement of an auxiliary electrode in the discharge lamp of FIG. 13.
Figure 16:
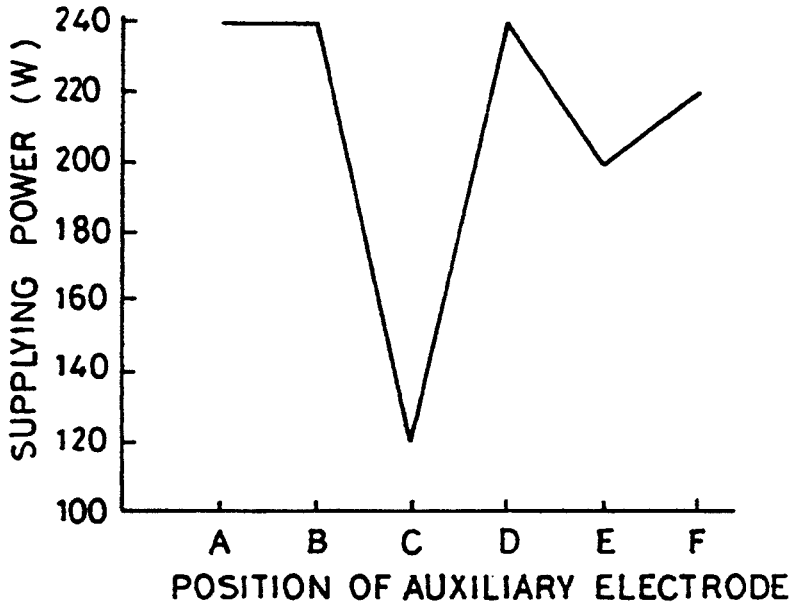
FIG. 16 is a graphic illustration of variation in required power supplied to the auxiliary electrode at different positions in FIG. 15 for shifting discharging state from a preliminary discharge with the auxiliary electrode to an annular main discharge with the induction coil.

In a further embodiment shown in FIG. 11 of the electrodeless discharge lamp according to the present invention, the arrangement is similar to that of the embodiment in FIG. 8, but the lamp tube 101 in cylindrical shape having on one axial end surface the auxiliary electrode 103 is so disposed within the induction coil 102 that the other axial end surface acting as the main luminescent surface 106 is substantially in match with the central plane intersecting at right angles the axial line of the coil 102. Since in this case the intensity of the induction electric field due to the high frequency electromagnetic field generated around the induction coil 102 is made to be the largest in the central area of the axial line of the induction coil 102 and to be smaller at both ends of the axial line, as shown in FIG. 12, the disposition of the main luminescent surface 106 of the lamp tube 101 substantially in match with the central plane 107 intersecting at right angles the axial line of the induction coil 102 is effective to have the strongest induction electric field acted upon the free end of the preliminary discharge $D_P$. Consequently, the shift of the discharge from the preliminary discharge $D_P$ to the arc discharge $D_A$ can be easily attained, and the startability of the discharge lamp can be further improved. In the present embodiment, all other constituents including the auxiliary electrode 103 and first and second high frequency power sources 104 and 105 are the same as those on the embodiment of FIG. 1.

Figure 17:
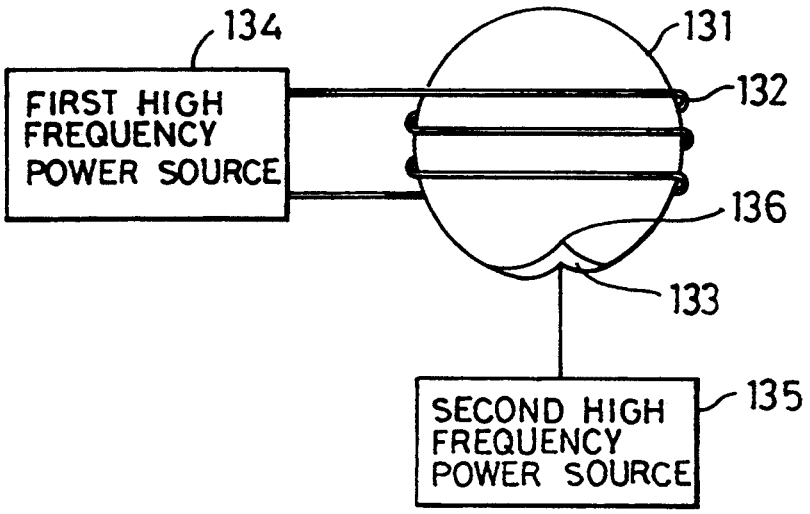
FIGS. 17 and 18 show in schematic diagrams arrangements of the discharge lamp in further different embodiments of the electrodeless discharge lamp according to the present invention.

In FIG. 17, there is shown a further embodiment of the electrodeless discharge lamp according to the present invention, in which the lamp tube 131 shaped generally spherical is provided at its part of peripheral wall with a recess 136, and the induction coil 132 is wound on this tube 131 so as to have the recess 136 disposed at one end of the axial line of the induction coil 132. In the recess 136, the single auxiliary electrode 133 is provided as closely adhered. For intimately closely adhering the auxiliary electrode 133 to the recess 136, the electrode should preferably be prepared in more than two sector shaped metal foils of a diameter of 5 mm, for example, so that the sector shaped foils can be joined into a conical shape with their linear edges coupled to each other. Now, as the high frequency voltage is applied to the auxiliary electrode 133 from the second high frequency power source 135 separate from the first high frequency power source 134 for supplying power to the induction coil 132, there arises from the auxiliary electrode 133 the string-shaped preliminary discharge $D_P$, upon which the top of the conical shape auxiliary electrode 133 projecting inward along the recess 136 of the lamp tube 131 functions to have the high frequency electric field concentrated thereto, so that the preliminary discharge will take place smooth and the startability of the discharge lamp can be eventually improved.

It also possible to form the auxiliary electrode 133 by applying and drying such liquid conductor as a liquid platinum in the recess 136, in which event improvement may be attained in the adhesion of the auxiliary electrode 133 to the lamp tube 131 and eventually in the startability of the discharge lamp, as will be readily appreciated. In this embodiment of FIG. 17, further, all other constituents are the same as those in the embodiment of FIG. 1.

Figure 18:
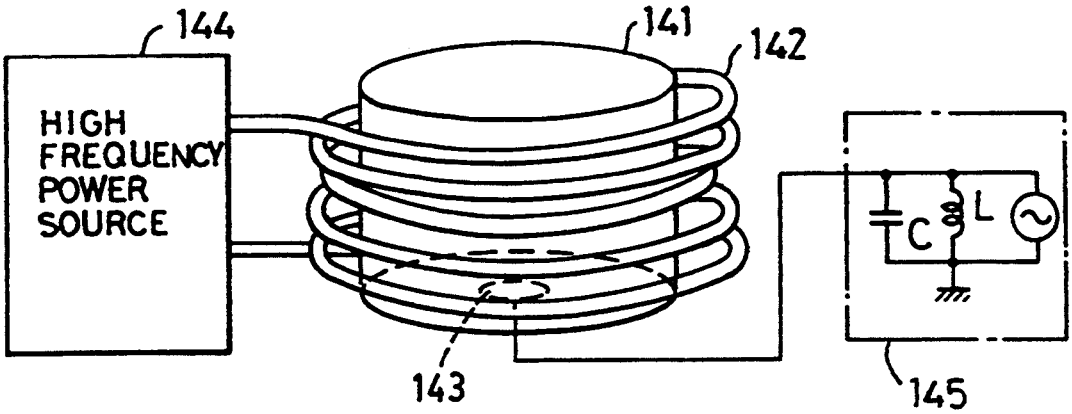
Figure 19:
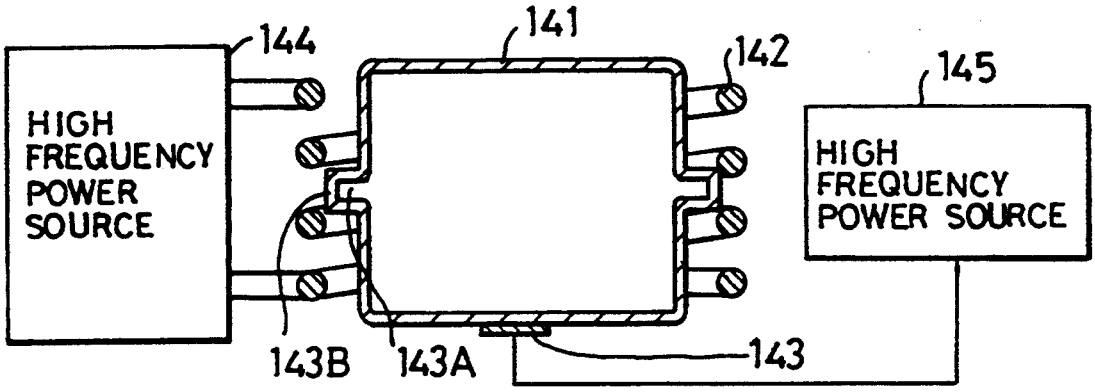
FIG. 19 is a schematic sectioned view of the electrodeless discharge lamp of FIG. 18.
Figure 20:
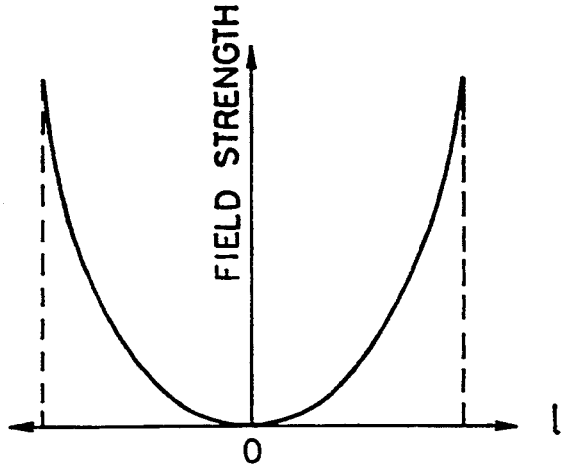
FIG. 20 is a graphic illustration of the relationship between varying distance l with respect to the induction coil in the electrodeless discharge lamp and the electric field strength.

FIGS. 18 and 19 show a still further embodiment of the electrodeless discharge lamp according to the present invention, in which the lamp tube 141 of a short cylindrical shape is formed to have an annular projection 143B defining an annular outward groove 143A in the center of peripheral wall of the cylindrical tube all over the circumference, and to dispose outer periphery of the annular projection 143B to be close to the induction coil 142 wound about the peripheral wall. In other wards, the induction coil 142 is so wound as to be separated from the peripheral wall by a distance slightly over projecting length of the annular projection 143B. In the center of the outer, flat bottom surface of the short cylindrical lamp tube 141, the single auxiliary electrode 143 consisting of a metal foil square-shaped with each 5 mm side is adhered. In this case, the intensity of the induction electric field will be the largest at the positions close to the windings of the induction coil 142 as shown by dotted lines in a graph of FIG. 20 and will be weaker as separated from the widings in the radial direction of the induction coil 142. Here, the provision of the annular projection 142B to the peripheral wall of the lamp tube 141 so as to dispose the outer periphery close to the induction coil 142 is rendering the intensity of the induction electric field to be the highest at the portions close to outer end of the annular projection 143B. That is, with the provision of the outward annular projection 143B, it is made possible to have the entire induction coil 142 separated from the lamp tube 141 but, of the other hand, to bring part of the peripheral wall and of the interior space of the lamp tube 141 closer to the induction coil 142. Provided that the induction coil 142 would be wound closely on the lamp tube 141, it would be possible to have the induction electric field acted efficiently upon the discharge gas but, during the occurrence of the annular discharge, a generated heat of the discharge gas inside the tube would be transmitted to the closely wound turns of the induction coil 142 to heat it to a higher temperature. When the induction coil 142 is made so hot, there arises a problem that the coil is entirely deformed, subjected to surface oxidation, or the like, and the induction coil 142 is made shorter in the life. On the other hand, the induction coil 142 in the embodiment of FIGS. 18 and 19 is separated from the lamp tube 142 except for the part of the annular projection 143B, so that the induction coil 142 can be prevented from being heated so hot, while assuring the excellent startability of the discharge lamp by means of the annular projection 143B of the lamp tube and the auxiliary electrode 143 as well.

In the present embodiment, further, a provision of a high voltage generating means adjacent to the lamp tube 141 for generating a high voltage upon application of the voltage from the second high frequency power source 145 to the auxiliary electrode 143 will render the ionization of the discharge gas to be easier, and the startability of the lamp is further improved. For this high voltage generating means, there may be employed one for subjecting a piezo-electric element to an impact.

In the embodiment of FIGS. 18 and 19, all other constituents are the same as those in the embodiment of FIG. 1.

Figure 21:
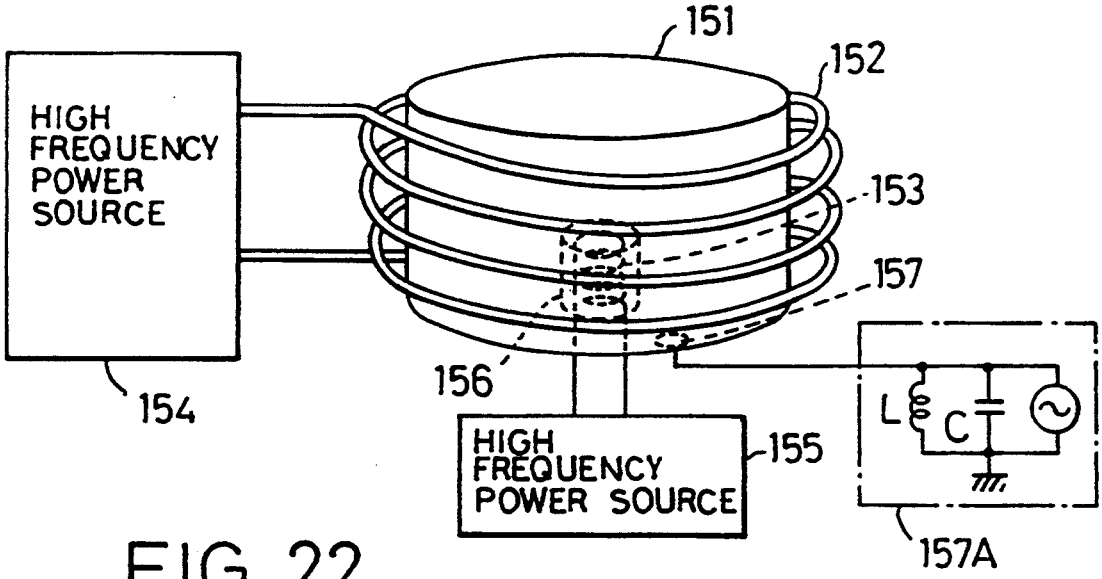
FIG. 21 shows in a schematic diagram still another embodiment of the electrodeless discharge lamp according to the present invention.
Figure 22:
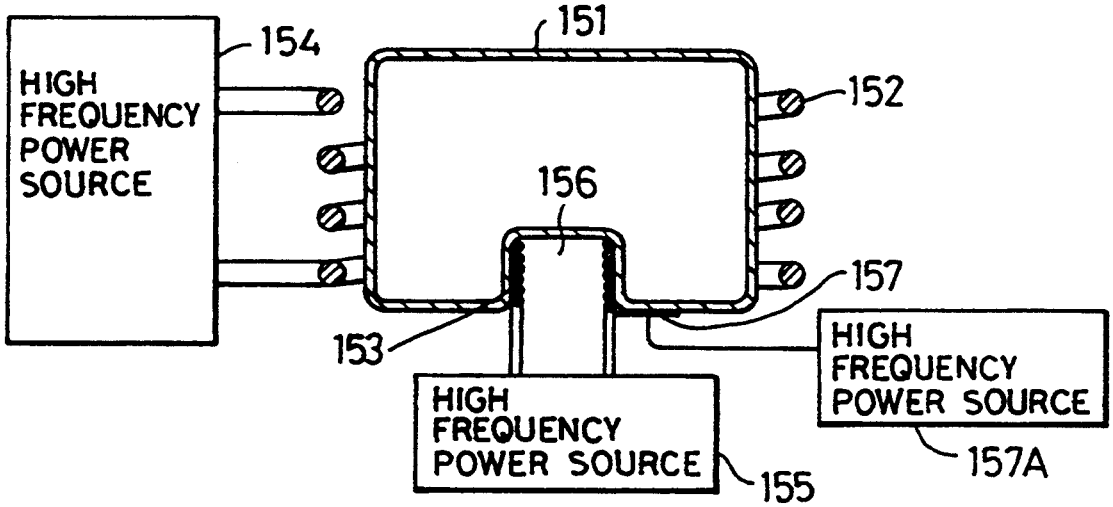
FIG. 22 is a schematic sectioned view of the lamp in the embodiment of FIG. 21.

FIGS. 21 and 22 are of still another embodiment of the electrodeless discharge lamp according to the present invention, in which the short cylindrical lamp tube 151 is formed to have a recess 156 in the center of one axial end surface, and an auxiliary coil 153 for generating a preliminary discharge is accommodated within this recess 156. In this case, the auxiliary coil 153 is disposed to be substantially coaxial with the induction coil 152 wound on the cylindrical lamp tube 151. Further, on the same axial end surface as that having the recess 156, the auxiliary electrode 157 of a square metal foil with each 5 mm side, for example, is provided to be adjacent to the recess 156 disposing therein the auxiliary coil 153, and a high frequency voltage is applied from a third high frequency power source 157A which is similar to the second high frequency power source employed in the foregoing embodiments.

In the present embodiment, the high frequency voltage is applied initially from the third high frequency power source 157A to the auxiliary electrode 157 to generate a string shape discharge, then a current is supplied from the second high frequency power source 155 to the auxiliary coil 153 to thereby generate the high frequency electromagnetic field intersecting the auxiliary coil 153, and an induction electric field intersecting this high frequency electromagnetic field is generated. Since the particular induction electric field is formed to lie along the windings of the auxiliary coil 153, the string shape discharge generated initially by the auxiliary electrode 157 is induced to grow annular along such induction electric field.

Figure 23:
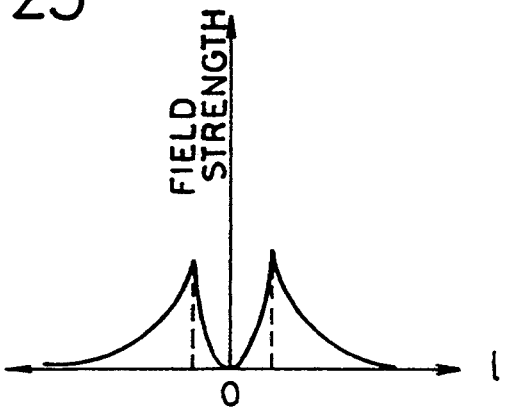
FIG. 23 is a graphic illustration of the relationship between varying distance l with respect to the auxiliary electrode and the electric field strength in the embodiment of FIG. 21.
Figure 24:
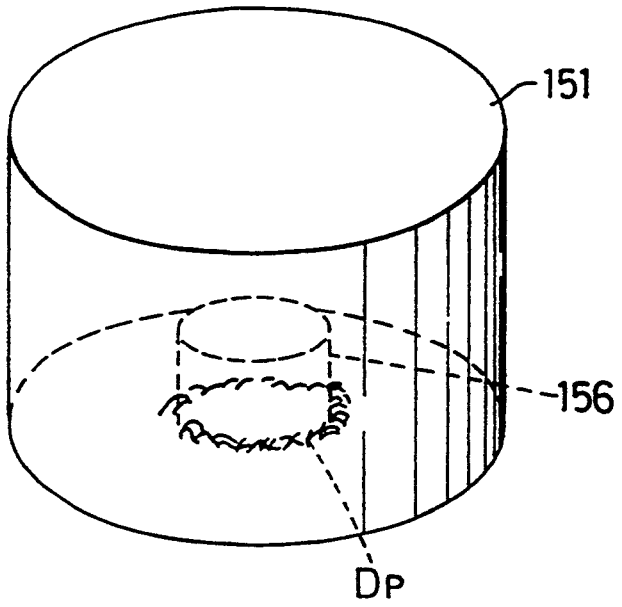
FIG. 24 is an explanatory view for the operation of the auxiliary electrode in the embodiment of FIG. 21.
Figure 25:
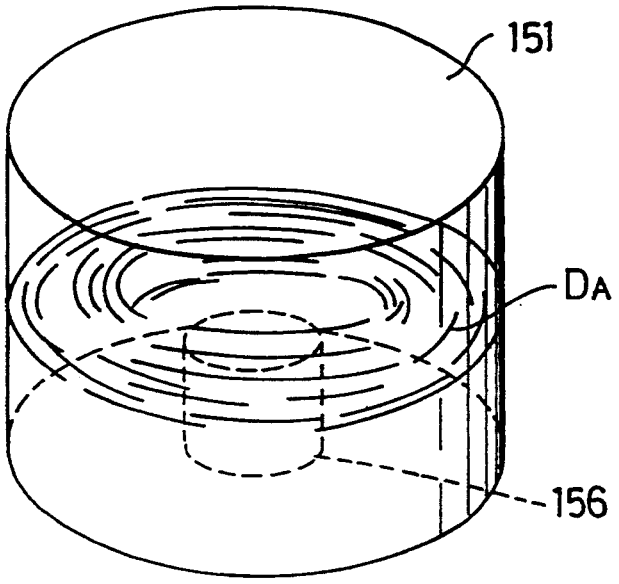
FIG. 25 is an explanatory view for the operation of the induction coil in the embodiment of FIG. 21.

As shown graphically in FIG. 23 by broken lines, the induction electric field generated by the auxiliary coil 153 is strongest at annular area adjacent to the windings of the coil 153 and becomes weaker as separated away from the auxiliary coil 153 in its radial direction. Consequently, the preliminary discharge $D_P$ induced annular about the auxiliary coil 153 is to be generated adjacent to the central recess 156 with a slightly larger diameter than that of the recess 156 within the lamp tube 151, as schematically shown in FIG. 24. At the moment when the annular preliminary discharge $D_P$ is thus generated, the high frequency current is supplied from the first high frequency power source 154 to the induction coil 152, and the high frequency electromagnetic field intersecting the induction coil 152 then generated, which electromagnetic field intersecting the annular preliminary discharge $D_P$. Due to this generation of the high frequency electromagnetic field, the preliminary discharge $D_P$ is caused to rise in its electron density so that, with the supplied current to the induction coil 152 increased, such annular arc discharge $D_A$ of a large discharge path length as shown schematically in FIG. 25 will be maintained to be generated According to this arrangement described above, the annular discharge in the very initial stage of the lamp starting can be made smaller in the diameter, required power supply for its generation can be minimized, the shift of the initial annular discharge to the larger annular discharge by means of the induction coil 152 can be attained with a smaller energy, and the whole required power supply for the lamp lighting can be reduced, as will be readily appreciated.

In the embodiment shown in FIGS. 28 and 29, all other constituents are the same as those in the embodiment of FIG. 1.

Figure 26:
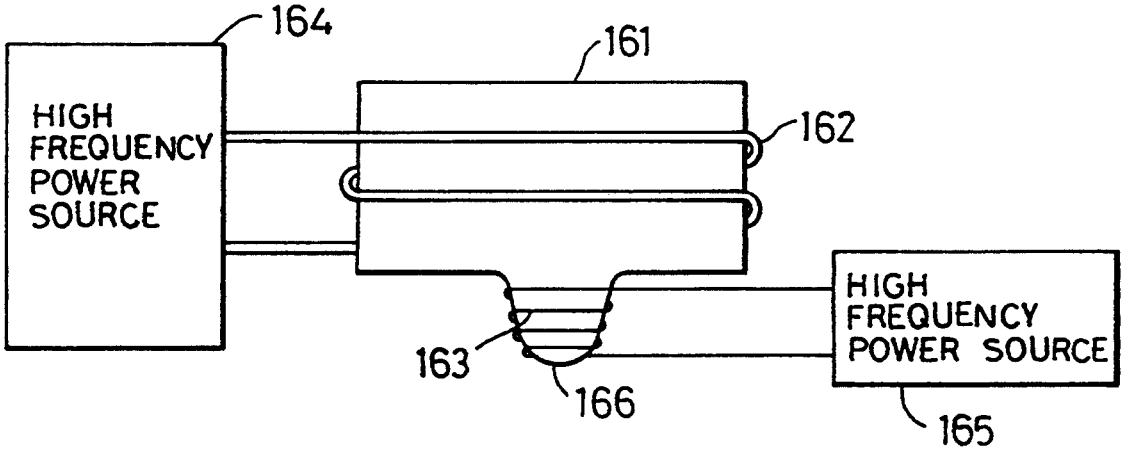
FIGS. 26 and 27 show in schematic diagrams further embodiments of the electrodeless discharge lamp according to the present invention.

In still another embodiment shown in FIG. 26 of the electrodeless discharge lamp according to the present invention, the short cylindrical lamp tube 161 on which the induction coil 162 is wound to be supplied with the current from the high frequency power source 164 is formed to include a projection 166 swelling at an axial end, and an auxiliary coil 163 is provided as wound on the projection 166 to be supplied with the power from the second high frequency power source 165. With this arrangement, the discharge lamp is made easier to be worked. Other constituents in this embodiment of FIG. 26 are the same as those in the embodiment of FIG. 1.

Figure 27:
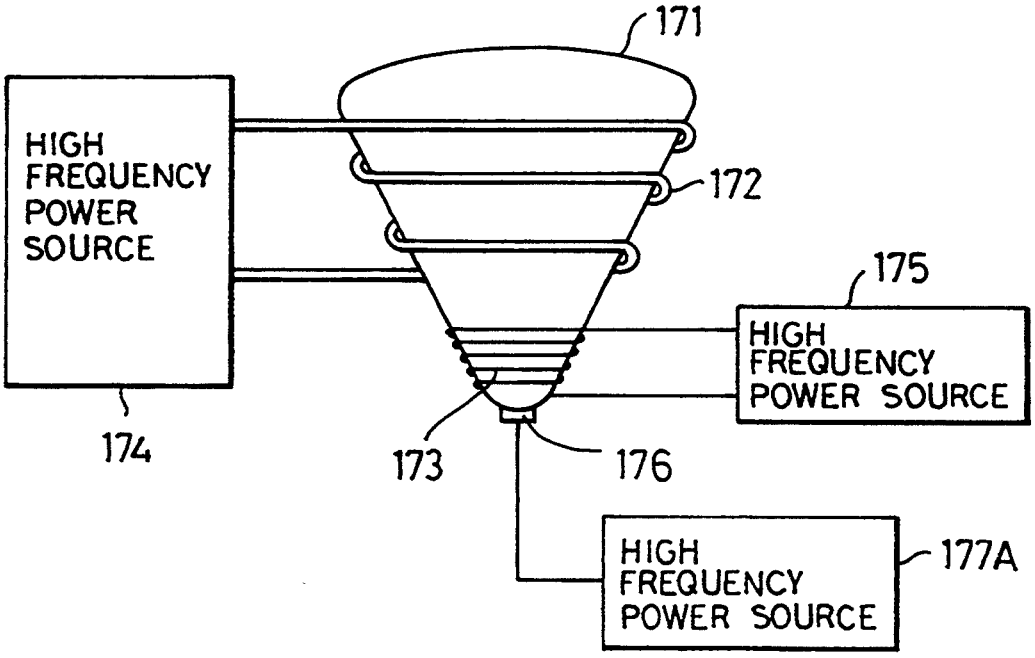

In a still further embodiment shown in FIG. 27 of the electrodeless discharge lamp, the lamp tube 171 is formed into a conical shape with its base surface used as the main luminescent surface, the induction coil 172 to which the power is supplied from the first high frequency power source 174 is wound on the substantial part of the periphery on the side of the base, while the auxiliary coil 173 to which the power is supplied from the second high frequency power source 175 is wound on remaining peripheral part on the side of the top of the conical tube, and the auxiliary electrode 176 to which the voltage is applied from the third high frequency power source 177A is adhered to the top part of the conical tube 171 shown to be downward in the drawing. Other constituents in this embodiment of FIG. 27 are the same as those in the embodiment of FIG. 1.

What is claimed is:

1. An electrodeless discharge lamp comprising:

a lamp tube including a light-transmitting material;

a discharge gas sealed within said lamp tube;

an induction coil, including at least a single loop, disposed around an outer periphery of said lamp tube for generating a high frequency electromagnetic field acting upon said discharge gas in said lamp tube;

a first high frequency power source for supplying a first high frequency current to said induction coil;

a foil type auxiliary electrode disposed adjacent to said outer peripheral wall of said lamp tube substantially the same distance from points around said induction coil and electrostatically coupled to an interior space of said lamp tube for generating a preliminary discharge of the discharge gas in said lamp tube prior to generation of an excitation luminescence by means of said induction coil; and a second high frequency power source for applying a second high frequency voltage to said foil type auxiliary electrode, wherein said lamp tube includes a recess formed by a substantially concave portion of said outer peripheral wall, said foil type auxiliary electrode being disposed within said recess.

2. The discharge lamp according to claim 1 wherein a portion of said substantially concave portion is substantially parallel to a plane passing through said single loop and wherein said recess extends less than half way through said induction coil.

* * * * *